US012345435B2

(12) United States Patent
Seo et al.

(10) Patent No.: US 12,345,435 B2
(45) Date of Patent: Jul. 1, 2025

(54) COMMUNICATION KIT

(71) Applicant: LG ELECTRONICS INC., Seoul (KR)

(72) Inventors: Beomsoo Seo, Seoul (KR); Joonshik Yoon, Seoul (KR); Junho Hwang, Seoul (KR); Pilhyun Yoon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 329 days.

(21) Appl. No.: 17/791,009

(22) PCT Filed: Jun. 12, 2020

(86) PCT No.: PCT/KR2020/007661
§ 371 (c)(1),
(2) Date: Jul. 6, 2022

(87) PCT Pub. No.: WO2021/145517
PCT Pub. Date: Jul. 22, 2021

(65) Prior Publication Data

US 2023/0028955 A1 Jan. 26, 2023

(30) Foreign Application Priority Data

Jan. 16, 2020 (KR) ..... 10-2020-0005908

(51) Int. Cl.
*F24F 11/65* (2018.01)
*F24F 11/32* (2018.01)
(Continued)

(52) U.S. Cl.
CPC ..... *F24F 11/65* (2018.01); *F24F 11/32* (2018.01); *F24F 11/56* (2018.01); *F24F 11/61* (2018.01); *F24F 2110/10* (2018.01)

(58) Field of Classification Search
CPC combination set(s) only.
See application file for complete search history.

(56) References Cited

U.S. PATENT DOCUMENTS 6,009,939 A 1/2000 Nakanishi et al.
10,240,809 B1 * 3/2019 Duvivier ..... F24F 11/30
(Continued)

FOREIGN PATENT DOCUMENTS

CN 101650062 A 2/2010
CN 102846830 1/2013
(Continued)

OTHER PUBLICATIONS

Japanese Office Action dated Aug. 1, 2023 issued in Application 2022-543140.
(Continued)

*Primary Examiner* — Ramesh B Patel
(74) *Attorney, Agent, or Firm* — KED & ASSOCIATES, LLP

(57) ABSTRACT

A communication kit comprising a communication module configured to communicate with a thermostat, an indoor unit, and an outdoor unit; and a controller configured to generate an operation signal to be transmitted to the indoor unit and the outdoor unit, based on a signal received from the thermostat, wherein the controller is configured to determine an operation mode of the indoor unit and the outdoor unit based on an indoor temperature when a backup function of the thermostat is executed.

16 Claims, 7 Drawing Sheets

(51) Int. Cl.

| | |
|---|---|
| ***F24F 11/56*** | (2018.01) |
| ***F24F 11/61*** | (2018.01) |
| *F24F 110/10* | (2018.01) |

(56) References Cited

U.S. PATENT DOCUMENTS

| | | | | |
|---|---|---|---|---|
| 2005/0125102 | A1 | 6/2005 | Nichols et al. | |
| 2009/0183693 | A1 | 7/2009 | Furman | |
| 2010/0023168 | A1 | 1/2010 | Kai et al. | |
| 2017/0074537 | A1 | 3/2017 | Bentz et al. | |
| 2017/0075568 | A1 | 3/2017 | Bentz et al. | |
| 2017/0146260 | A1* | 5/2017 | Ribbich | G05B 19/0426 |
| 2019/0195523 | A1* | 6/2019 | Mowris | F24F 11/61 |
| 2019/0353370 | A1 | 11/2019 | Hern et al. | |
| 2019/0353372 | A1* | 11/2019 | Rigg | F24F 11/38 |
| 2020/0149764 | A1* | 5/2020 | Sinha | G05D 23/1905 |
| 2020/0233440 | A1* | 7/2020 | Gillette | F24F 11/76 |
| 2020/0309398 | A1* | 10/2020 | Uerkvitz | F24F 11/52 |
| 2024/0068689 | A1* | 2/2024 | Carpenter | F24F 3/044 |

FOREIGN PATENT DOCUMENTS

| | | | |
|---|---|---|---|
| JP | H 062915 | A | 1/1994 |
| JP | H 0682086 | A | 3/1994 |
| JP | H 09236297 | A | 9/1997 |
| JP | 2008-101897 | A | 5/2008 |
| JP | 2009-257602 | | 11/2009 |
| JP | 2016-003787 | A | 1/2016 |
| JP | 2019-066107 | A | 4/2019 |
| KR | 10-1029988 | | 4/2011 |
| KR | 10-2018-0041446 | A | 4/2018 |

OTHER PUBLICATIONS

International Search Report dated Sep. 22, 2020 issued in Application No. PCT/KR2020/007661.

Chinese Office Action dated Mar. 23, 2023 issued in Application 202080091430.2.

Chinese Office Action dated Nov. 9, 2023 issued in Application No. 202080091430.2.

* cited by examiner

[Fig. 1]
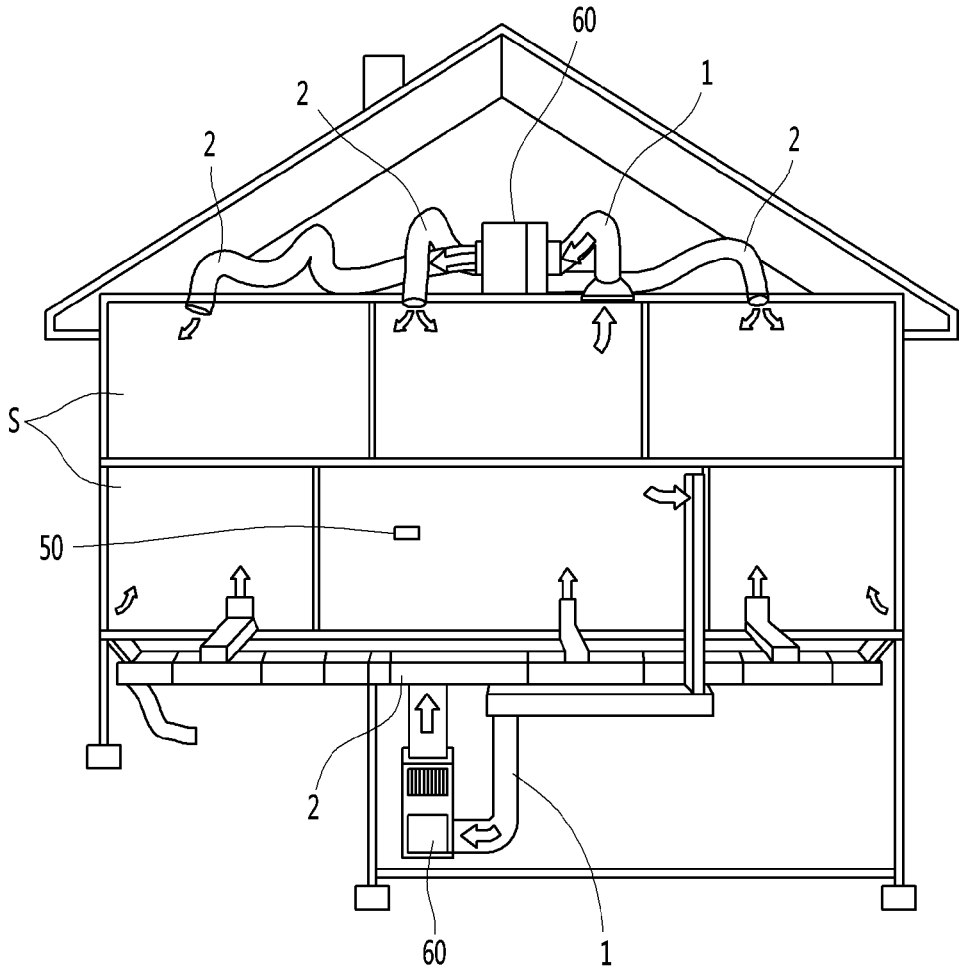
[Fig. 2]
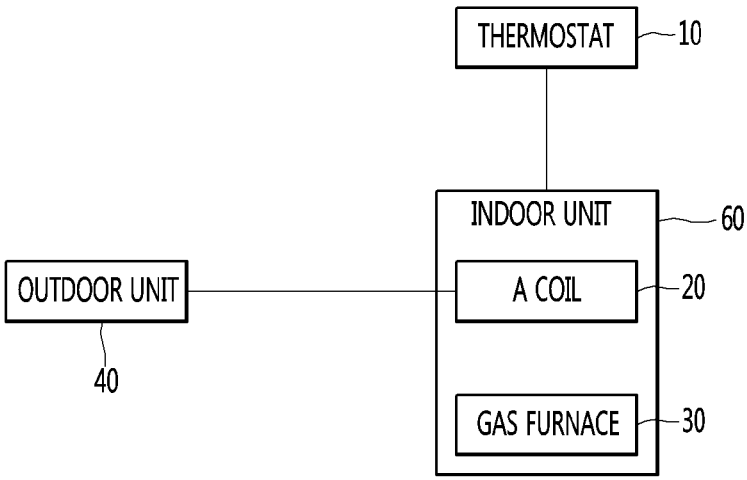

[Fig. 3]
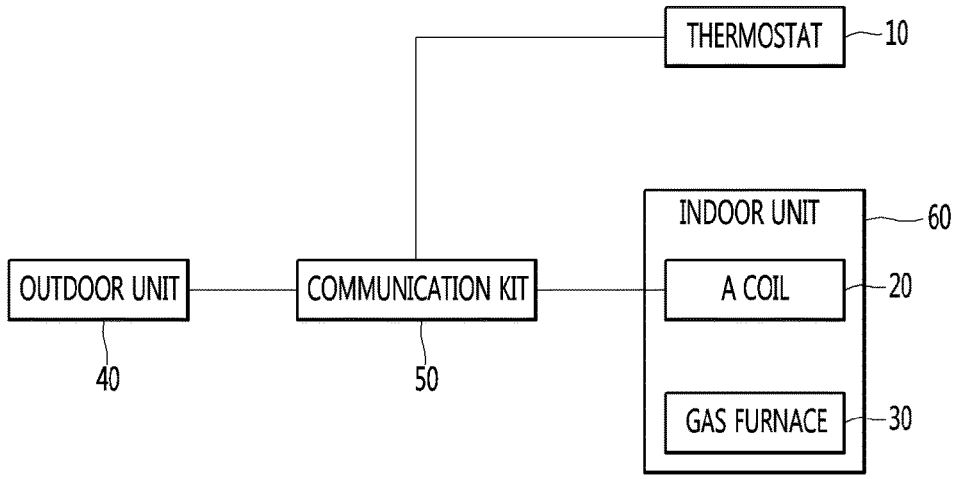
[Fig. 4]
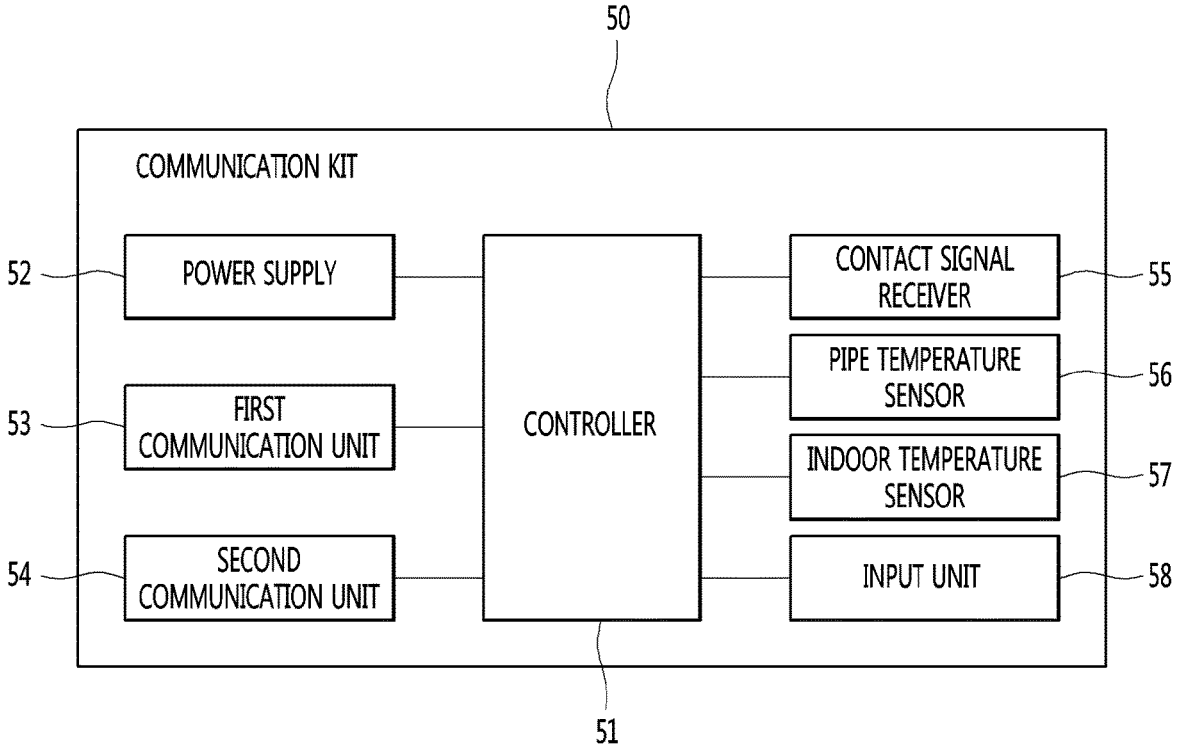

[Fig. 5]
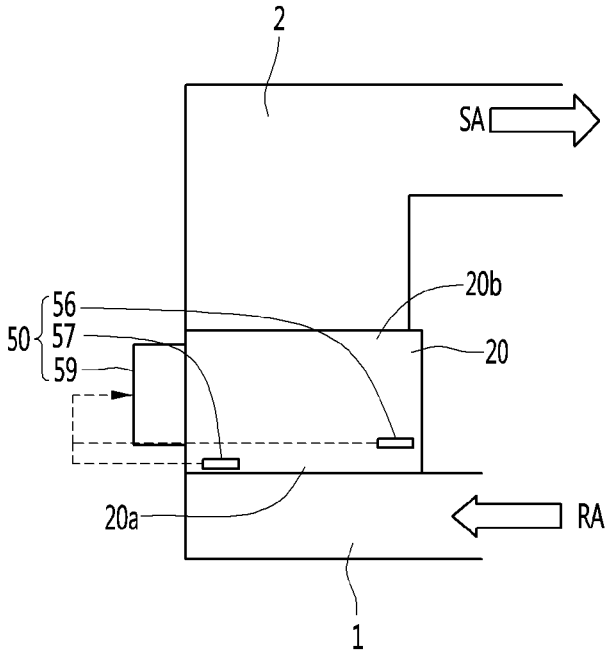
[Fig. 6]
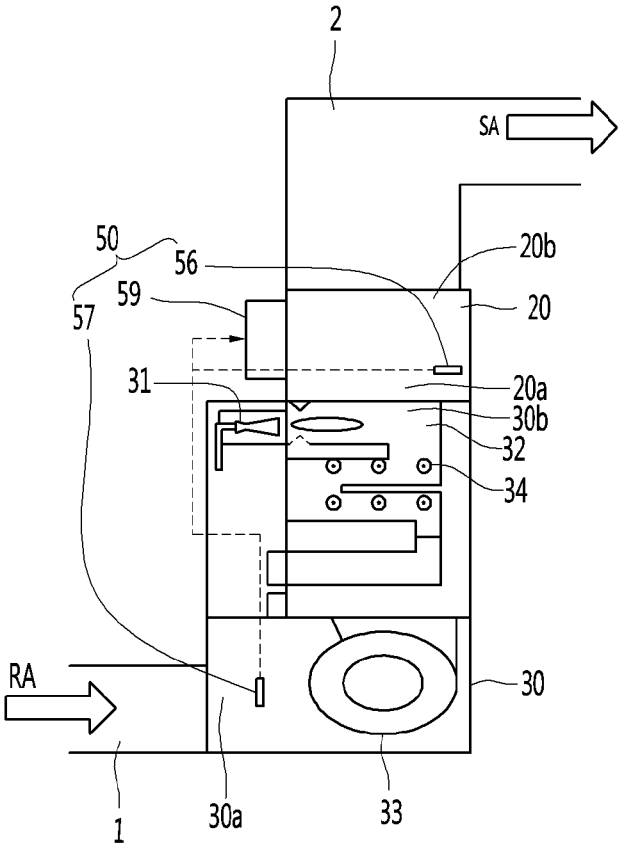

[Fig. 7]
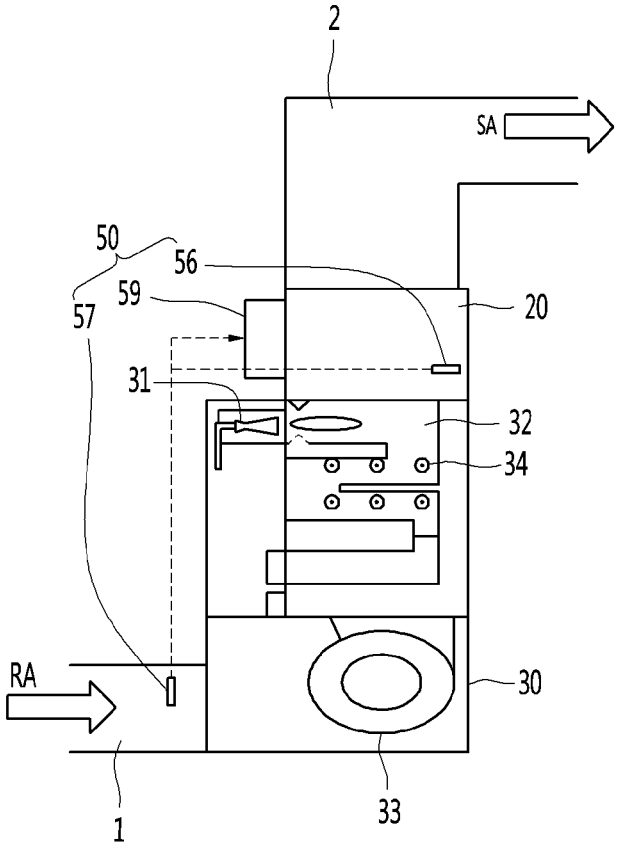

[Fig. 8]
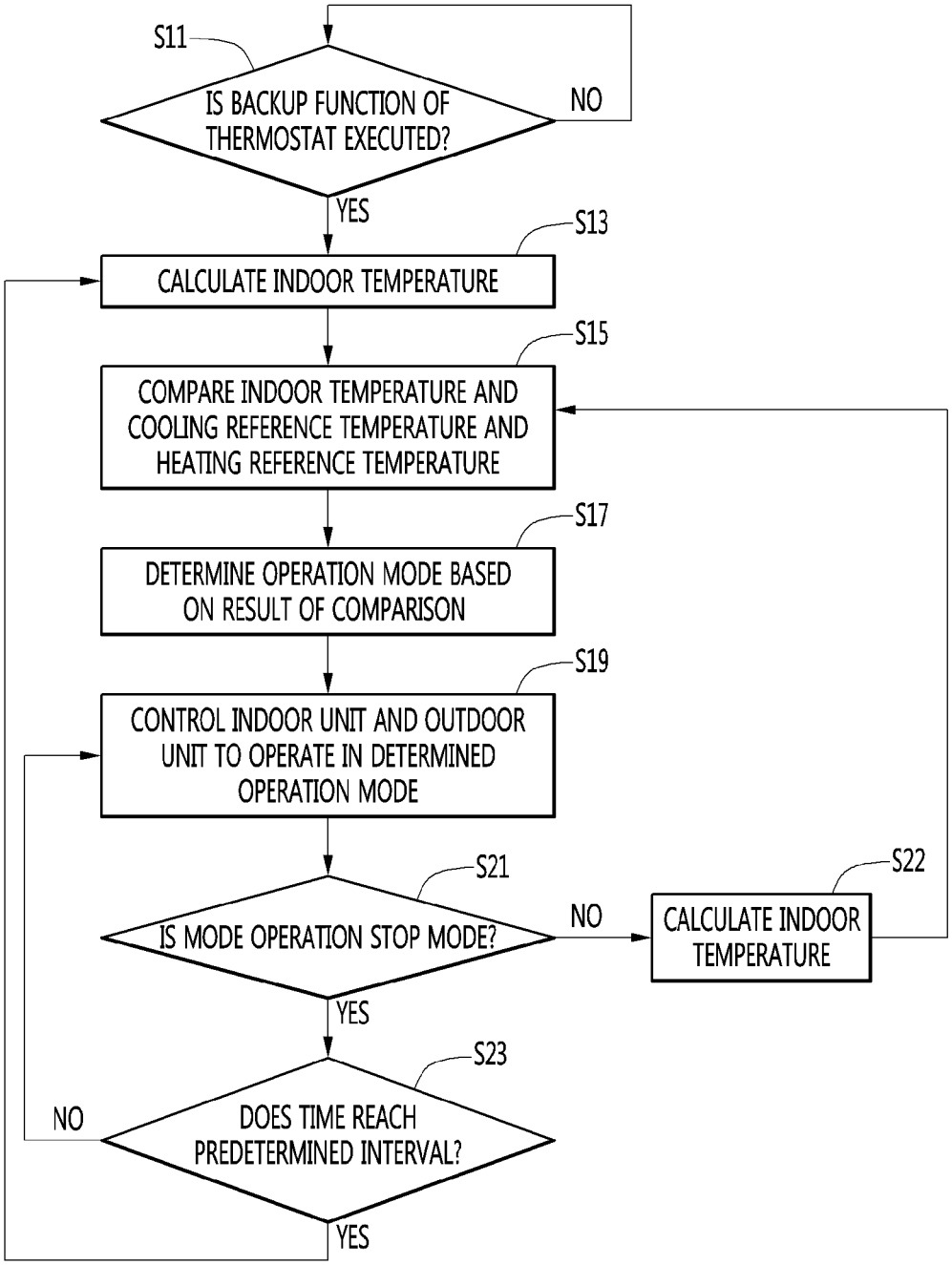

[Fig. 9]
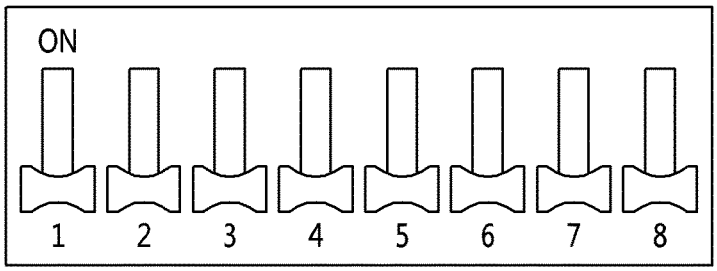
| Dip Switch | No. 7 | No. 8 |
|---|---|---|
| 0 (Off) | BACKUP FUNCTION OFF | MINIMUM EMERGENCY OPERATION ($T_{Heat}$ = 18℃, $T_{Cool}$ = 29℃) |
| 1 (On) | BACKUP FUNCTION ON | COMFORTABLE EMERGENCY OPERATION ($T_{Heat}$ = 20℃, $T_{Cool}$ = 26℃) |
[Fig. 10]
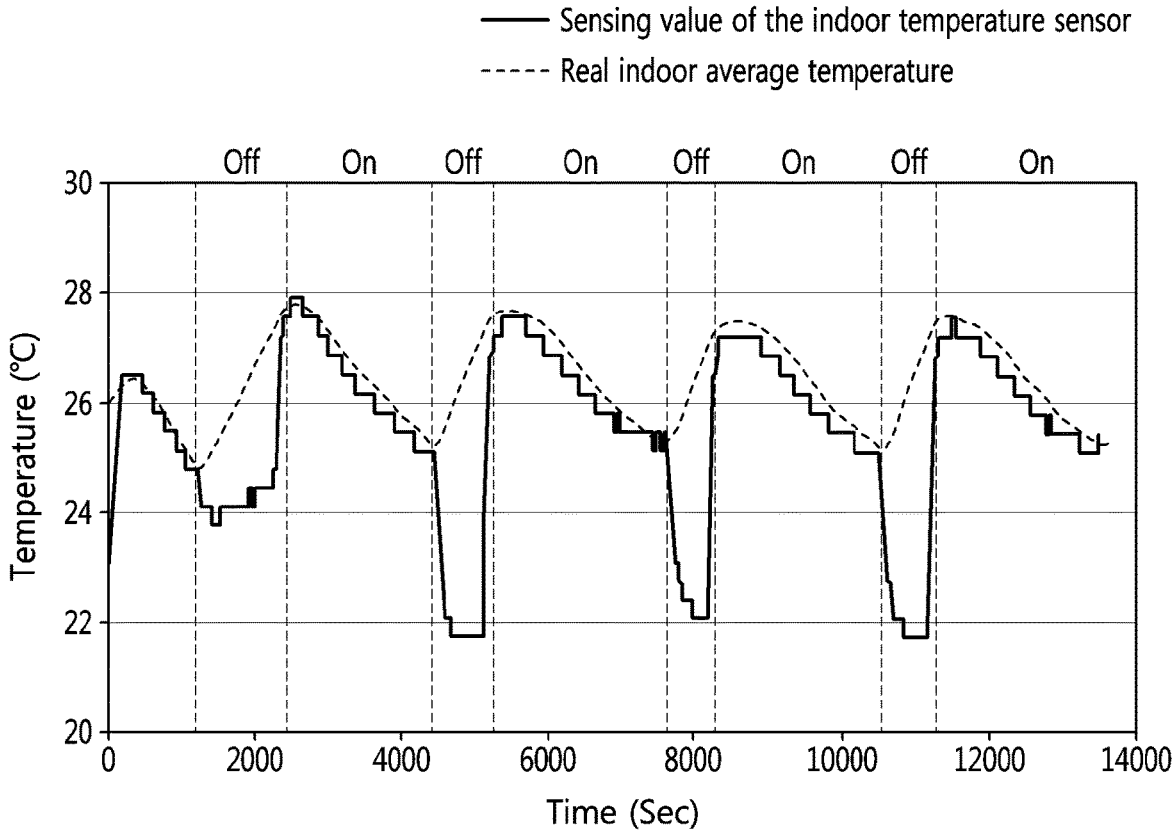

[Fig. 11]
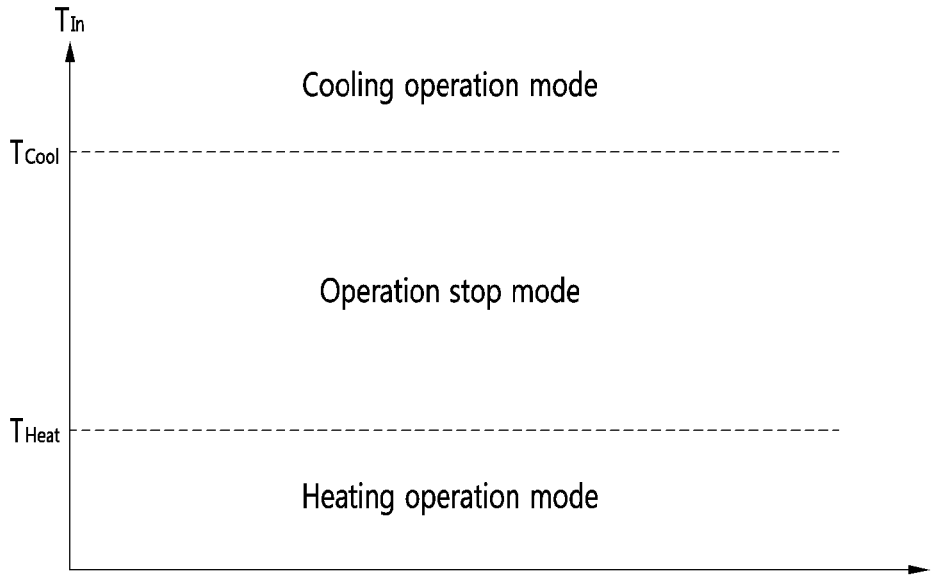
[Fig. 12]
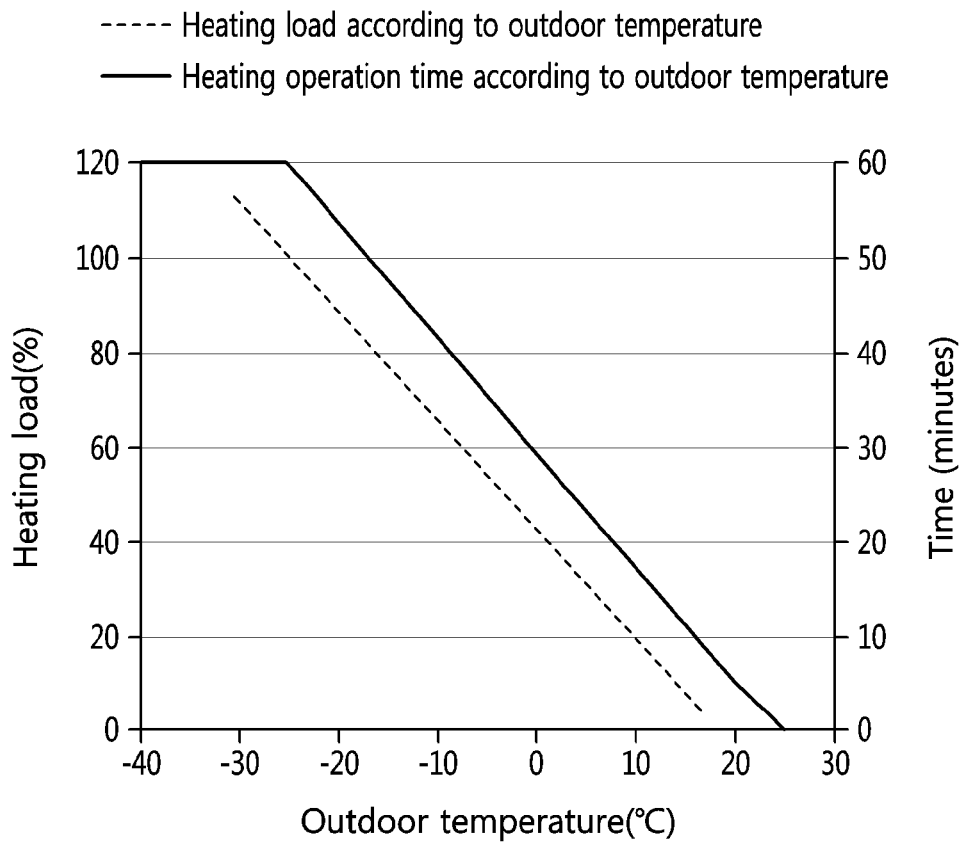

COMMUNICATION KIT

CROSS-REFERENCE TO RELATED PATENT APPLICATIONS

This application is a U.S. National Stage Application under 35 U.S.C. § 371 of PCT Application No. PCT/KR2020/007661, filed Jun. 12, 2020, which claims priority to Korean Patent Application No. 10-2020-0005908, filed Jan. 16, 2020, whose entire disclosures are hereby incorporated by reference.

TECHNICAL FIELD

The present disclosure relates to a communication kit, and more particularly, to a communication kit which is used for an interlocking operation of a unitary system.

BACKGROUND ART

In general, unitary systems are a type of centralized air-conditioning systems that make cold air or warm air by using air-conditioning apparatuses provided in basements of factories, offices, hotels, homes, or the like and transfer and supply the cold air or the warm air to individual spaces through ducts provided in walls of buildings.

In unitary systems, a zone controller is installed in the middle of a duct so as to separate a zone that requires air conditioning and a zone that does not require air conditioning and independently supply cold air or warm air to each individual zone, or a plurality of air conditioning mechanisms are independently installed according to the number of zones.

Unitary systems may include an outdoor unit installed outside buildings, an indoor unit installed in the basements or ceilings of buildings, and a thermostat. The thermostat is a temperature regulator and may be installed indoors. A user may set a temperature of an indoor space through the thermostat, and the thermostat may transmit an on/off signal to the indoor unit and the outdoor unit such that the temperature of the indoor space maintains the set temperature. The indoor unit or the outdoor unit may operate according to the on/off signal received from the thermostat.

When such a thermostat is out of order, the thermostat may not transmit the on/off signal to the indoor unit or the outdoor unit, and accordingly, a problem that temperature in the indoor space is not controlled may arise. That is, when the thermostat is out of order, the indoor unit and the outdoor unit may not know a set temperature even if the indoor unit and the outdoor unit normally operates, and indoor air may be overheated or overcooled, and accordingly, user inconvenience may be caused.

DISCLOSURE OF INVENTION

Technical Problem

The present disclosure may provide a communication kit which can implement an emergency operation when a thermostat is out of order.

The present disclosure may provide a communication kit which can minimize overheating or overcooling of indoor air when a thermostat is out of order.

The present disclosure may provide a communication kit which can select an indoor temperature even when a thermostat is out of order.

The present disclosure may provide a communication kit which can minimize a confusion which may be caused when a signal is received from a thermostat during an emergency operation.

Solution to Problem

A communication kit according to an embodiment of the present disclosure may operate an indoor unit and an outdoor unit based on an indoor temperature when executing a backup function of a thermostat.

The communication kit according to an embodiment of the present disclosure may operate the indoor unit and the outdoor unit to adjust the indoor temperature to be lower than a cooling reference temperature and higher than a heating reference temperature when the thermostat is out of order.

The communication kit according to an embodiment of the present disclosure may receive an input of changing the cooling reference temperature or the heating reference temperature when the backup function of the thermostat is executed.

The communication kit according to an embodiment of the present disclosure may adjust a heating operation time based on an outdoor temperature when a heating operation is performed through a gas furnace.

The communication kit according to an embodiment of the present disclosure may not process a signal received from the thermostat during an emergency operation.

The communication kit according to an embodiment of the present disclosure may include a dip switch to receive selection regarding whether to execute the backup function of the thermostat or selection of an operation method when the backup function is executed.

Advantageous Effects of Invention

According to embodiments of the present disclosure, since the indoor unit and the outdoor unit are operated based on the indoor temperature, there is an advantage that an emergency operation of the unitary system can be performed even when the thermostat is out of order.

According to embodiments of the present disclosure, since the indoor temperature is adjusted to be lower than the cooling reference temperature and higher than the heating reference temperature, a problem that indoor air is overheated or overcooled can be minimized.

Since the communication kit according to embodiments of the present disclosure receives an input of changing the cooling reference temperature or the heating reference temperature, there is an advantage that the indoor temperature can be adjusted according to user's preference even when the thermostat is out of order.

According to embodiments of the present disclosure, there is an advantage that a heating operation can be prevented from being performed for a very long time or a very short time, by adjusting a heating operation time based on an outdoor temperature even when the communication kit does not know the indoor temperature.

According to embodiments of the present disclosure, there is an advantage that an operation confusion of the indoor unit and the outdoor unit can be minimized by abstaining from processing a signal received from the thermostat during an emergency operation.

According to embodiments of the present disclosure, since selection regarding whether to execute the backup function or selection of an operation method when the backup function is executed is received through the dip switch, there is an advantage that a structure and a control algorithm of the communication kit for receiving the selection regarding whether to execute the backup function or the selection of the operation method when the backup function is executed, can be simplified, and addition of a cost for manufacturing can be minimized.

BRIEF DESCRIPTION OF DRAWINGS

FIG. 1 is a schematic diagram illustrating an installation state of a unitary system according to an embodiment of the present disclosure.

FIG. 2 is a block diagram of the unitary system according to an embodiment of the present disclosure.

FIG. 3 is a block diagram of the unitary system according to another embodiment of the present disclosure.

FIG. 4 is a control block diagram of the communication kit according to an embodiment of the disclosure.

FIG. 5 is a view illustrating an example of installation of the indoor temperature sensor according to a first embodiment of the present disclosure.

FIG. 6 is a view illustrating an example of installation of the indoor temperature sensor according to a second embodiment of the present disclosure.

FIG. 7 is a view illustrating an example of installation of the indoor temperature sensor according to a third embodiment of the present disclosure.

FIG. 8 is a sequence diagram illustrating an operating method of the communication kit according to an embodiment of the present disclosure.

FIG. 9 is a view illustrating an example of the input unit of the communication kit according to an embodiment of the present disclosure.

FIG. 10 is a graph illustrating a sensing value of the indoor temperature sensor and a real indoor average temperature according to an embodiment of the present disclosure.

FIG. 11 is an exemplary graph illustrating an operation mode determined according to the indoor temperature according to an embodiment of the present disclosure.

FIG. 12 is a graph illustrating a heating operation time adjusted by the communication kit according to an outdoor temperature according to an embodiment of the present disclosure.

BEST MODE FOR CARRYING OUT THE INVENTION

Hereinafter, specific embodiments of the present disclosure will be described in detail with reference to the accompanying drawings.

FIG. 1 is a schematic diagram illustrating an installation state of a unitary system according to an embodiment of the present disclosure, and FIG. 2 is a block diagram of the unitary system according to an embodiment of the present disclosure.

The unitary system may include a thermostat 10 that receives a temperature control command, and an outdoor unit 40 and an indoor unit 60 that operate based on the temperature control command received by the thermostat 10.

The outdoor unit 40 may be installed outside a building and may include a compressor, an outdoor fan, and the like. The outdoor unit 40 may include an outdoor temperature sensor (not shown) to detect an outdoor temperature. The outdoor unit 40 may transmit the outdoor temperature detected by the outdoor temperature sensor (not shown) to a communication kit 50 (see FIG. 3).

The thermostat 10 and the indoor unit 60 may be installed in an indoor space S. For example, the thermostat 10 may be installed in a space where a user stays, and the indoor unit 60 may be installed in a basement, a ceiling, an outbuilding, or the like of the building.

Examples of the indoor unit 60 may include an A coil 20 and a gas furnace 30. The indoor unit 60 comprises at least one of the A coil 20 or the gas furnace 30.

The A coil 20 may perform a cooling operation or a heating operation. For example, the A coil 20 may cool air flowing through a duct during the cooling operation, or may heat air flowing through the duct during the heating operation. The A coil 20 may serve as a heat exchanger through which a refrigerant flows.

The gas furnace 30 may perform a fanning operation or a heating operation. For example, the gas furnace 30 may circulate air by driving only a fan during the fanning operation, or may heat air through exhaust of high temperature generated by combustion of fuels during the heating operation.

However, the A coil 20 and the gas furnace 30 are merely examples for convenience of explanation, and are not limited thereto.

The indoor unit 60 may supply cooled or heated air to the indoor space S through a supply passage 2, recover indoor air through a recovery passage 1 communicating with the indoor space S, and cool or heat the air again.

The supply passage 2 and the recovery passage 1 may be formed as ducts, and the supply passage 2 and the recovery passage 1 may be disposed at different positions.

When there are a plurality of indoor spaces S, the supply passage 2 may be branched into a plurality of passages to supply cooled or heated air to each indoor space S.

The thermostat 10 is a temperature regulator. The thermostat 10 may include a temperature sensor and may receive a temperature control command from a user. When a temperature measured by the temperature sensor is different from a temperature set through the temperature control command, the thermostat 10 may transmit an on/off signal, a contact signal, so as to operate the outdoor unit 40 and the indoor unit 60.

The thermostat 10 may be connected with the indoor unit 60, for example, the gas furnace 30, and the indoor unit 60 may be connected with the outdoor unit 40. The thermostat 10 may transmit an on signal or an off signal to the indoor unit 60, and the indoor unit 60 may transmit the on signal or the off signal to the outdoor unit 40. Alternatively, unlike in FIG. 2, the thermostat 10 may be connected with the outdoor unit 40 and the indoor unit 60, respectively, and may transmit the on signal or the off signal to the outdoor unit 40 and the indoor unit 60, respectively.

FIG. 3 is a block diagram of the unitary system according to another embodiment of the present disclosure.

The unitary system according to another embodiment of the present disclosure may include a thermostat 10, an outdoor unit 40, an indoor unit 60, and a communication kit 50. That is, the unitary system according to another embodiment of the present disclosure may further include a communication kit 50, compared to the unitary system shown in FIG. 2.

The communication kit 50 may communicate with the thermostat 10, the indoor unit 40, and the outdoor unit 60. When the communication kit 50 receives a contact signal such as an on signal or an off signal from the thermostat 10, the communication kit 50 may transmit an operation signal to control the outdoor unit 40 and the indoor unit 60 to operate according to the contact signal.

The communication kit 50 may perform an emergency operation. The emergency operation may be an operation of the communication kit 50 controlling the outdoor unit 40 and the indoor unit 60 regardless of whether a signal is received from the thermostat 10 when the thermostat 10 is out of order.

The communication kit 50 may receive an input of selecting whether to execute a backup function of the thermostat 10. The communication kit 50 may not perform the backup function of the thermostat 10 or may perform the backup function of the thermostat 10 according to the received input.

When the backup function of the thermostat 10 is not executed, the communication kit 50 may control the outdoor unit 40 and the indoor unit 60 according to a contact signal received from the thermostat 10.

When the backup function of the thermostat 10 is executed, the communication kit 50 may control the outdoor unit 40 and the indoor unit 60 based on an indoor temperature.

FIG. 4 is a control block diagram of the communication kit according to an embodiment of the disclosure.

The communication kit 50 may include at least one of a controller 51, a power supply 52, communication devices (or modules) 53, 54, 55, a pipe temperature sensor 56, an indoor temperature sensor 57, and an input unit 58, and the communication unites 53, 54, 55 may include a first communication unit 53, a second communication unit 54, and a contact signal receiver 55.

The controller 51 may control the power supply 52, the first communication unit 53, the second communication unit 54, the contact signal receiver 55, the pipe temperature sensor 56, the indoor temperature sensor 57, and the input unit 58, respectively.

The controller 51 may generate an operation signal to be transmitted to the indoor unit 60 and the outdoor unit 40 based on a signal received from the thermostat 10.

The power supply 52 may be supplied with power necessary for operating the communication kit 50 from the outside. The power supply 52 may convert power supplied from the outside and may supply the power to the components provided in the communication kit 50, respectively. The power supply 52 may include a switched mode power supply (SMPS).

The first communication unit 53 may be connected to the outdoor unit 40 by wire or wireless so as to transmit or receive signals with the outdoor unit 40. The second communication unit 54 may be connected to the indoor unit 60 by wire or wireless so as to transmit or receive signals with the indoor unit 60. Meanwhile, in FIG. 4, components for communicating with the outdoor unit 40 and components for communicating with the indoor unit 60 are separated into the first communication unit 53 and the second communication unit 54, but this is merely an example. One communication unit may communicate with the outdoor unit 40 and the indoor unit 60.

The contact signal receiver 55 may receive an on signal or an off signal. The contact signal receiver 55 may be dry contact.

According to one embodiment, the contact signal receiver 55 may receive an on/off signal from the thermostat 10.

Specifically, the thermostat 10 may transmit the on/off signal to the communication kit 50. For example, the thermostat 10 may transmit an on/off signal for a cooling operation, an on/off signal for a heating operation, an on/off signal for a blowing operation and the like to the communication kit 50.

According to another embodiment, unlike in FIG. 3, the thermostat 10 may be connected to the indoor unit 60, and the communication kit 50 may be connected between the outdoor unit 40 and the indoor unit 60. In this case, the thermostat 10 may transmit an on/off signal to the indoor unit 60, the indoor unit 60 may transmit an on/off signal to the communication kit 50, and the contact signal receiver 55 may receive an on/off signal from the indoor unit 60.

According to another embodiment, the thermostat 10 may transmit an on/off signal to the indoor unit 60 together with the communication kit 50, and the contact signal receiver 55 may receive an on/off signal from at least one of the thermostat 10 or the indoor unit 60.

Hereinafter, it is assumed that the contact signal receiver 55 receives a contact signal from the thermostat 10.

The pipe temperature sensor 56 may be installed inside the indoor unit 60, in particular, the A coil 20. The controller 51 may control at least one of the A coil 20 and the outdoor unit 40 based on a pipe temperature detected by the pipe temperature sensor 56.

The indoor temperature sensor 57 may be a temperature sensor for detecting a temperature of the indoor space S. The indoor temperature sensor 57 may be installed on an air suction unit of the indoor unit 60 or the recovery passage 1 connected with the indoor unit 60. The position of the indoor temperature sensor 57 will be described in detail with reference to FIGS. 5 to 7.

The input unit 58 may receive an input from a user. For example, the input unit 58 may receive at least one of an input of selecting whether to execute the backup function of the thermostat 10 or an input of selecting an operation method when the backup function of the thermostat 10 is turned on.

The input unit 58 may include a key or a button for receiving an input from a user. For example, the input unit 58 may be a DIP switch, but this is merely an example and is not limited.

FIG. 5 is a view illustrating an example of installation of the indoor temperature sensor according to a first embodiment of the present disclosure.

The indoor temperature sensor 57 may be installed in the air suction unit of the A coil 20.

Specifically, the A coil 20 may have the air suction unit 20*a* connected with the recovery passage 1, and an air discharge unit 20*b* connected with the supply passage 2, and the indoor temperature sensor 57 may be installed in the air suction unit 20*a* of the A coil 20. That is, as shown in FIG. 5, the indoor temperature sensor 57 may be installed close to the air suction unit 20*a* out of the air suction unit 20*a* of the A coil 20 and the air discharge unit 20*b* of the A coil 20.

FIG. 6 is a view illustrating an example of installation of the indoor temperature sensor according to a second embodiment of the present disclosure.

The indoor temperature sensor 57 may be installed in an air suction unit of the gas furnace 30.

Specifically, the gas furnace 30 and the A coil 20 may be connected with each other. That is, the gas furnace 30 may be disposed under the A coil 20, and the A coil 20 and the gas furnace 30 may fluidly communicate with each other. The gas furnace 30 may have a first air suction unit 30*a* and a first air discharge unit 30*b*, and the A coil 20 may have a second air suction unit 20*a* and a second air discharge unit 20*b*. The first air suction unit 30*a* of the gas furnace 30 may be connected with the recovery passage 1, the first air discharge unit 30*b* of the gas furnace 30 may be connected with the second air suction unit 20*a* of the A coil 20, and the second air discharge unit 20*b* of the A coil 20 may be connected with the supply passage 2. The A coil 20 may be installed on an upper portion of the gas furnace 30. In this case, the indoor temperature sensor 57 may be installed in the first air suction unit 30*a* of the gas furnace 30.

The gas furnace 30 may include at least one of a burner 31 for burning fuels, an exhaust passage 32 through which exhaust generated by burning of fuels passes, a blower 33 for guiding air supplied through the first air suction unit 30*a* to the exhaust passage 32, and a heat exchanger 34 installed on the exhaust passage 32. In this case, the indoor temperature sensor 57 may be installed between the recovery passage 1 and the blower 33.

The ordinals such as "first" and "second" are used for convenience of explanation and the present disclosure are not limited by them.

FIG. 7 is a view illustrating an example of installation of the indoor temperature sensor according to a third embodiment of the present disclosure.

As shown in FIG. 7, the indoor temperature sensor 57 may be installed on the recovery passage 1.

When the indoor temperature sensor 57 is installed as shown in FIGS. 5 to 7, the indoor temperature sensor 57 may detect a temperature of the indoor space S. The temperature of the indoor space S may be a suction temperature of the indoor unit 60.

The positions of the indoor temperature sensor 57 shown in FIGS. 5 to 7 are merely examples, and are not limited thereto. When the A coil 20 is disposed on an upper portion of the gas furnace 30, the indoor temperature sensor 57 may be installed in the A coil 20.

The communication kit 50 may further include a case 59 to accommodate at least one of the controller 51, the power supply 52, the first and second communication units 53, 54 and the contact signal receiver 55, and the case 59 may be installed on an outer surface of the A coil 20, but the position of the case 59 is merely an example.

In addition, the input unit 58 may be accommodated in the case 59 or may be disposed on an outer surface of the case 59. In this case, the user may turn on or off the backup function of the thermostat 10 or may select an operation method of the backup function through the input unit 58. The position of the input unit 58 described above is merely an example and the position of the input unit 58 is not limited. For example, the input unit 58 may be separated from the case 59 and may be disposed in the indoor space S.

The communication kit 50 may execute the backup function of the thermostat 10 when receiving a command to turn on the backup function of the thermostat 10 through the input unit 58. When the backup function of the thermostat 10 is executed, the controller 51 may determine an operation mode of the indoor unit 60 and the outdoor unit 40, based on an indoor temperature, and hereinafter, a specific method regarding this will be described.

FIG. 8 is a sequence diagram illustrating an operating method of the communication kit according to an embodiment of the present disclosure.

The controller 51 may determine whether the backup function of the thermostat 10 is executed (S11).

The backup function of the thermostat 10 may refer to a function of the communication kit 50 controlling the outdoor unit 40 and the indoor unit 60, instead of the thermostat 10. The backup function of the thermostat 10 may be a function that is provided in case the thermostat 10 is out of order. When the thermostat 10 is out of order, the user may execute the backup function of the thermostat 10. The communication kit 50 may receive an input regarding whether to execute the backup function of the thermostat 10 through the input unit 58.

FIG. 9 is a view illustrating an example of the input unit of the communication kit according to an embodiment of the present disclosure.

As shown in FIG. 9, the input unit 58 may be a dip switch. The dip switch may receive an input of turning on or off the backup function of the thermostat 10 or an input of selecting an operation method when the backup function of the thermostat 10 is turned on. For example, number 7 (No. 7) of the dip switch may determine whether to turn on/off the backup function of the thermostat, and number 8 (No. 8) of the dip switch may determine an operation method when the backup function of the thermostat is turned on. In this case, the controller 51 may turn off the backup function when number 7 of the dip switch is 0 (off), and may turn on the backup function when number 7 of the dip switch is 1 (on).

In addition, the controller 51 may determine the operation method to be a first emergency operation method when number 7 of the dip switch is 1 (on) and number 8 of the dip switch is 0 (off), and may determine the operation method to be a second emergency operation method when number 7 of the dip switch is 1 (on) and number 8 of the dip switch is 1 (on). Although FIG. 9 illustrates that the operation method is determined to be one of the two methods when the backup function of the thermostat is turned on, the operation method may be one mode or two or more methods.

The first emergency operation method is a minimum emergency operation mode and may be an operation mode for minimizing overheating or overcooling of air of the indoor space S to prevent the outdoor unit 40 and the indoor unit 60 from stopping the operations. The second emergency operation method is a comfortable emergency operation mode, and may be an operation mode for making air of the indoor space S comparatively comfortable by driving the outdoor unit 40 and the indoor unit 60 more frequently than in the first emergency operation method.

In the first emergency operation method, a heating reference temperature may be controlled by a first temperature and a cooling reference temperature may be controlled by a second temperature, and, in the second emergency operation method, the heating reference temperature may be controlled by a third temperature which is higher than the first temperature, and the cooling reference temperature may be controlled by a fourth temperature which is lower than the second temperature. In addition, the first temperature and the third temperature may be lower than the fourth temperature, and the second temperature and the fourth temperature may be higher than the third temperature.

The controller 51 may determine that the backup function of the thermostat 10 is not executed when number 7 of the dip switch is 0 (off), and may determine that the backup function of the thermostat 10 is executed when number 7 of the dip switch is 1 (on).

Reference will be made back to FIG. 8.

The controller 51 may calculate an indoor temperature when the backup function of the thermostat 10 is executed (S13).

The controller 51 may calculate the indoor temperature based on a sensing value of the indoor temperature sensor 57.

According to the first embodiment, the controller 51 may calculate the indoor temperature with the sensing value of the indoor temperature sensor 57.

According to the second embodiment, the controller 51 may calculate the indoor temperature with the sensing value of the indoor temperature sensor 57 after performing a fanning operation for a predetermined time.

In the present disclosure, the fanning operation may be an operation of driving only an indoor fan of the indoor unit 60. For example, the controller 51 may operate only a fan provided in the gas furnace 30 during the fanning operation.

FIG. 10 is a graph illustrating a sensing value of the indoor temperature sensor and a real indoor average temperature according to an embodiment of the present disclosure.

An On period shown in FIG. 10 refers to a period during which the indoor fan operates, and an off period shown in FIG. 10 refers to a period during which the indoor unit 60 including the indoor fan and the outdoor unit 40 do not operate. In addition, the dashed line shown in FIG. 10 may be a graph indicating a real indoor average temperature, and the real indoor average temperature may refer to an average of temperatures of air of the indoor space S. The solid line shown in FIG. 10 may be a graph indicating a sensing value of the indoor temperature sensor 57.

Referring to FIG. 10, the sensing value of the indoor temperature sensor 57 and the real indoor average temperature are similar to each other when the indoor fan operates, whereas there is a comparatively big difference between the sensing value of the indoor temperature sensor 57 and the real indoor average temperature when the indoor fan does not operate.

Accordingly, it can be seen from FIG. 10 that the indoor temperature can be estimated through the sensing value of the indoor temperature sensor 57 after the fanning operation is performed.

When the sensing value of the indoor temperature sensor 57 is calculated as the indoor temperature after the fanning operation is performed for the predetermined time as described above, a temperature of indoor air circulated to some degrees is calculated as the indoor temperature, and thus wrong detection of the indoor temperature caused in a special case where cooled or heated air temporarily blows can be minimized.

According to the third embodiment, when the fanning operation is performed for the predetermined time, the controller 51 may calculate, as the indoor temperature, an average of the sensing values of the indoor temperature sensor 57 for a set time before the fanning operation is finished. For example, the predetermined time may be 3 minutes and the set time may be 1 minute. However, this is merely an example and is not limited. As described above, when the fanning operation is performed for the predetermined time and the average of the sensing values of the indoor temperature sensor 57 for the set time before the fanning operation is finished is calculated as the indoor temperature, there are advantages that wrong detection of the indoor temperature caused by a special case can be minimized, and also, the accuracy of calculation of the indoor temperature can be enhanced through the average temperature.

Reference will be made back to FIG. 8.

When the indoor temperature is calculated, the controller 51 may compare the indoor temperature and the cooling reference temperature and the heating reference temperature (S15).

The controller 51 may detect whether the indoor temperature is lower or higher than the cooling reference temperature, or the indoor temperature is lower or higher than the heating reference temperature.

The cooling reference temperature and the heating reference temperature may be pre-set reference values for determining whether to operate the outdoor unit 40 and the indoor unit 60. In particular, the cooling reference temperature may be a pre-set reference value for determining whether to perform a cooling operation of the outdoor unit 40 and the indoor unit 60, and the heating reference temperature may be a pre-set reference value for determining whether to perform a heating operation of the outdoor unit 40 and the indoor unit 60.

According to an embodiment, when the backup function of the thermostat 10 is turned on, the communication kit 50 may support two or more operation method. In this case, the cooling reference temperature and the heating reference temperature may be different according to an operation method. For example, when the backup function is turned on and the operation method is the first emergency operation method, the heating reference temperature may be the first temperature (for example, 18° C.) and the cooling reference temperature may be the second temperature (for example, 29° C.), and, when the backup function is turned on and the operation method is the second emergency operation method, the heating reference temperature may be the third temperature (for example, 20° C.) and the cooling reference temperature may be the fourth temperature (for example, 26° C.). The controller 51 may compare the indoor temperature and the cooling reference temperature and the heating reference temperature corresponding to a current operation method.

Accordingly, the controller 51 may change the cooling reference temperature or the heating reference temperature when the backup function of the thermostat 10 is executed. For example, when a command to change the operation method is received through the input unit 58, the controller 51 may change the cooling reference temperature or the heating reference temperature. When a command to select the first emergency operation method as the operation method is received, the controller 51 may set the heating reference temperature to the first temperature (for example, 18° C.), and may change the cooling reference temperature to the second temperature (for example, 29° C.), and, when a command to select the second emergency operation method as the operation method is received, the controller 51 may set the heating reference temperature to the third temperature (for example, 20° C.) and may change the cooling reference temperature to the fourth temperature (for example, 26° C.).

The controller 51 may determine an operation mode based on a result of comparison (S17).

The controller 51 may control the indoor unit 60 and the outdoor unit 40 to operate in a cooling operation mode, a heating operation mode, or an operation stop mode, based on the indoor temperature.

Next, referring to FIG. 11, a method for the controller 51 to determine an operation mode based on a result of comparing the indoor temperature and the cooling reference temperature and the heating reference temperature will be described.

FIG. 11 is an exemplary graph illustrating an operation mode determined according to the indoor temperature according to an embodiment of the present disclosure.

If the indoor temperature Tin is higher than the cooling reference temperature Tcool, the controller 51 may determine the operation mode to be the cooling operation mode, and, if the indoor temperature Tin is lower than the heating reference temperature Theat, the controller 51 may determine the operation mode to be the heating operation mode.

In addition, if the indoor temperature Tin is higher than the heating reference temperature Theat and is lower than the cooling reference temperature Tcool, the controller 51 may determine the operation mode to be the operation stop mode.

That is, when the backup function of the thermostat 10 is executed, the controller 51 may generate an operation signal to control the indoor unit 60 and the outdoor unit 40 to perform a cooling operation if the indoor temperature $T_{in}$ is higher than the cooling reference temperature $T_{cool}$, and may generate an operation signal to control the indoor unit 60 and the outdoor unit 40 to perform a heating operation if the indoor temperature $T_{in}$ is lower than the heating reference temperature $T_{heat}$. In addition, when the backup function of the thermostat 10 is executed, the controller 51 may control the indoor unit 60 and the outdoor unit 40 in the operation stop mode if the indoor temperature $T_{in}$ is lower than the cooling reference temperature $T_{cool}$ and is higher than the heating reference temperature $T_{heat}$.

Reference will be made back to FIG. 8.

The controller 51 may control the indoor unit 60 and the outdoor unit 40 to operate in the determined operation mode (S19).

The controller 51 may control the indoor unit 60 and the outdoor unit 40 to perform the cooling operation when the operation mode is determined to be the cooling operation mode, may control the indoor unit 60 and the outdoor unit 40 to perform the heating operation when the operation mode is determined to be the heating operation mode, and may control the indoor unit 60 and the outdoor unit 40 to finish the operation when the operation mode is determined to be the operation stop mode.

When the controller 51 controls the indoor unit 60 and the outdoor unit 40 to perform the cooling operation or heating operation, the controller 51 may control the indoor unit 60 and the outdoor unit 40 to perform the cooling operation or the heating operation for a predetermined operation time. For example, when the determined operation mode is the cooling operation mode or the heating operation mode, the controller 51 may control the indoor unit 60 and the outdoor unit 40 to perform the cooling operation or heating operation for the predetermined operation time (for example, 30 minutes). The controller 51 may determine the operation mode to be the operation stop mode after controlling the indoor unit 60 and the outdoor unit 40 to perform the cooling operation or heating operation for the predetermined operation time.

The controller 51 may determine whether the operation mode is the operation stop mode (S21).

The controller 51 may determine that the operation mode is not the operation stop mode when the indoor unit 60 and the outdoor unit 40 perform the cooling operation or heating operation.

The controller 51 may calculate the indoor temperature when the operation mode is not the operation stop mode (S22).

That is, when the operation mode is not the operation stop mode, the controller 51 may calculate the indoor temperature, and may control the indoor unit 60 and the outdoor unit 40 according to an operation mode which is determined as a result of comparing the calculated indoor temperature and the cooling reference temperature and the heating reference temperature.

When the controller 51 calculates the indoor temperature while operating in the cooling operation mode or the heating operation mode as in step S22, the controller 51 may not perform the fanning operation and may calculate a sensing value of the indoor temperature sensor 57 as the indoor temperature. This is because, when the fanning operation is performed during the operation in the cooling operation mode or heating operation mode, the air of the indoor space S may not be appropriately cooled or heated.

It may be difficult for the controller 51 to calculate the indoor temperature. For example, when the indoor temperature sensor 57 is installed in the A coil 20 and the heating operation is performed by using the gas furnace 30, the indoor temperature sensor 57 may detect temperature of air heated by the gas furnace 30, and thus may not calculate the indoor temperature. In this case, the controller 51 may adjust a heating operation time based on an outdoor temperature.

That is, according to an embodiment, the controller 51 may adjust the heating operation time according to the outdoor temperature when the heating operation is performed through the backup function of the thermostat 10, which will be described in detail below.

FIG. 12 is a graph illustrating a heating operation time adjusted by the communication kit according to an outdoor temperature according to an embodiment of the present disclosure.

The dashed line shown in FIG. 12 may indicate a heating load necessary for a building according to an outdoor temperature defined by ASHRAE. That is, referring to the dashed line shown in FIG. 12, it can be seen that the heating load necessary for the building increases as the outdoor temperature decreases.

Accordingly, the controller 51 may adjust the heating operation time long as the outdoor temperature decreases. The solid line shown in FIG. 12 may indicate the heating operation time according to the outdoor temperature. The communication kit 50 may pre-store the heating operation time which is mapped onto each of the outdoor temperatures, as indicated by the solid line graph shown in FIG. 12.

When the indoor temperature sensor 57 is installed in the A coil 20 and the heating operation is performed by using the gas furnace 30, the controller 51 may receive an outdoor temperature from the outdoor unit 40 instead of calculating the indoor temperature in step S22, and may determine a heating operation time according to the received outdoor temperature. In this case, the controller 51 may control the indoor unit 60 and the outdoor unit 40 to perform the heating operation during the determined heating operation time, and may return to step S21 to determine whether the operation mode is the operation stop mode.

However, when the indoor temperature sensor 57 is installed in an air suction port of the gas furnace 30 or the recovery passage 1, or the cooling operation is performed, the controller 51 may calculate the indoor temperature as in step S22, and may determine the operation mode by comparing the calculated indoor temperature and the cooling reference temperature and the heating reference temperature.

Reference will be made back to FIG. 8.

When the operation mode is the operation stop mode, the controller 51 may determine whether the operation stop mode is performed during a predetermined interval (S23).

When entering the operation stop mode, the controller 51 may initialize (reset) a timer and may count a time for which the operation stop mode is performed. That is, the controller 51 may initialize the timer for counting the interval every time the indoor unit 60 and the outdoor unit 40 stop the operation. When the backup function of the thermostat 10 is executed, the controller 51 may determine the operation mode of the indoor unit 60 and the outdoor unit 40 based on the indoor temperature which is calculated by performing the fanning operation at predetermined intervals.

When the time for which the operation stop mode is performed does not reach the predetermined interval, the controller 51 may return to S19. That is, when the time for which the operation stop mode is performed does not reach the predetermined interval, the controller 51 may control the indoor unit 60 and the outdoor unit 40 to continuously operate according to the current operation mode.

On the other hand, when the time for which the operation stop mode is performed reaches the predetermined interval, the controller 51 may return to step S13. That is, when the time for which the operation stop mode is performed reaches the predetermined interval, the controller 51 may re-calculate the indoor temperature and may re-determine the operation mode by comparing the re-calculated indoor temperature and the cooling reference temperature and the heating reference temperature.

That is, even when the controller 51 operates in the operation stop mode, the controller 51 may calculate the indoor temperature at the predetermined intervals, and may control the indoor unit 60 and the outdoor unit 40 to operate again when the indoor temperature is lower than the heating reference temperature or is higher than the cooling reference temperature.

The controller 51 may determine whether the backup function of the thermostat 10 is terminated while operating according to the sequence shown in FIG. 8. That is, when receiving an input of turning off the backup function of the thermostat 10 through the input unit 58 while operating according to the sequence shown in FIG. 8, the controller 51 may terminate the backup function of the thermostat 10. When the backup function of the thermostat 10 is terminated, the controller 51 may control the indoor unit 60 and the outdoor unit 40 based on a contact signal received form the thermostat 10.

In addition, the controller 51 may not process a signal received from the thermostat 10 while performing the backup function of the thermostat 10. Since the indoor unit 60 and the outdoor unit 40 operate according to the indoor temperature while the controller 51 performs the backup function of the thermostat 10, there may be a confusion in the operation of the indoor unit 60 and the outdoor unit 40 when the indoor unit 60 and the outdoor unit 40 are controlled according to a contact signal received from the thermostat 10. That is, to prevent the signal confusion in the indoor unit 60 and the outdoor unit 40, the controller 51 may not process a signal received from the thermostat 10 while performing the backup function of the thermostat 10.

The above description is merely illustrative of the technical idea of the present disclosure, and various modifications and changes may be made thereto by those skilled in the art without departing from the essential characteristics of the present disclosure.

Therefore, the embodiments of the present disclosure are not intended to limit the technical spirit of the present disclosure but to illustrate the technical idea of the present disclosure, and the technical spirit of the present disclosure is not limited by these embodiments.

The scope of protection of the present disclosure should be interpreted by the appending claims, and all technical ideas within the scope of equivalents should be construed as falling within the scope of the present disclosure.

The invention claimed is:

1. A communication system comprising:

a communication module configured to:

communicate with a thermostat, communicate with an indoor unit configured for cooling and heating, and communicate with an outdoor unit configured for cooling and heating;

an input unit configured to receive an input to execute a backup function of the thermostat; and a controller configured to:

receive a signal from the thermostat, provide an operation signal to be transmitted by the communication module to the indoor unit and the outdoor unit, based on the signal received from the thermostat, based on the input received at the input unit, determine to execute the backup function of the thermostat in which the communication system is to control the indoor unit and the outdoor unit, and in response to the determination to execute the backup function of the thermostat based on the input received at the input unit, determine an operation mode of the indoor unit and the outdoor unit based on an indoor temperature, wherein, based on the determination to execute the backup function of the thermostat, the controller is configured to:

provide at least one operation signal to control the indoor unit and the outdoor unit to perform a cooling operation mode when the indoor temperature is higher than a cooling reference temperature, and provide at least one operation signal to control the indoor unit and the outdoor unit to perform a heating operation mode when the indoor temperature is lower than a heating reference temperature, wherein, based on the determination to execute the backup function of the thermostat, the controller is configured to change the cooling reference temperature or the heating reference temperature.

2. The communication system of claim 1, wherein, based on the determination to execute the backup function of the thermostat, the controller is configured to control the indoor unit and the outdoor unit to be in an operation stop mode when the indoor temperature is lower than the cooling reference temperature and the indoor temperature is higher than the heating reference temperature.

3. The communication system of claim 1, comprising an indoor temperature sensor for detecting the indoor temperature.

4. The communication system of claim 3, wherein the controller is configured to determine the indoor temperature by controlling a fanning operation of the indoor unit for a predetermined time and subsequently receiving a sensing value from the indoor temperature sensor.

5. The communication system of claim 3, wherein the controller is configured to determine the indoor temperature based on an average of sensing values of the indoor temperature sensor for a set time while controlling a fanning operation.

6. The communication system of claim 1, wherein, based on the determination to execute the backup function of the thermostat, the controller is configured to determine the operation mode of the indoor unit and the outdoor unit based on the indoor temperature which is determined by controlling a fanning operation at predetermined intervals.

7. The communication system of claim 6, wherein the controller is configured to initialize a timer which counts the interval every time the indoor unit and the outdoor unit complete the fanning operation.

8. The communication system of claim 1, wherein the controller is configured to control the indoor unit and the outdoor unit to operate in the cooling operation mode, the heating operation mode, or an operation stop mode based on the indoor temperature.

9. The communication system of claim 1, wherein the controller is configured to adjust a heating operation time according to an outdoor temperature when a heating operation is performed while executing the backup function of the thermostat.

10. The communication system of claim 9, wherein the controller is configured to adjust the heating operation time as the outdoor temperature becomes lower.

11. The communication system of claim 1, wherein the controller is configured to abstain from processing a signal received from the thermostat while the backup function of the thermostat is executed.

12. The communication system of claim 1, wherein the input unit is a dip switch configured to receive an input of tuning on or off the backup function of the thermostat, and to receive an input of selecting an operation method when the backup function of the thermostat is turned on.

13. A communication system comprising:

a communication-device module configured to:

communicate with a thermostat, communicate with an indoor unit configured for cooling and heating, and communicate with an outdoor unit configured for cooling and heating;

an input unit configured to receive an input to execute a backup function of the thermostat; and a controller configured to execute the backup function of the thermostat by:

determine an operation mode of the indoor unit and the outdoor unit based on an indoor temperature, and control the indoor unit and the outdoor unit to operate in a cooling operation mode, a heating operation mode, or an operation stop mode based on the determined operation mode, wherein the controller is to execute the backup function of the thermostat by:

provide at least one operation signal to control the indoor unit and the outdoor unit to perform the cooling operation mode when the indoor temperature is higher than a cooling reference temperature, and provide at least one operation signal to control the indoor unit and the outdoor unit to perform the heating operation mode when the indoor temperature is lower than a heating reference temperature, wherein, based on the execution of the backup function of the thermostat, the controller is configured to change the cooling reference temperature or the heating reference temperature.

14. The communication system of claim 13, wherein the controller is configured to execute the backup function of the thermostat by abstaining from processing a signal received from the thermostat while the backup function of the thermostat is executed.

15. The communication system of claim 13, wherein the controller is configured to execute the backup function of the thermostat by controlling the indoor unit and the outdoor unit to be in the operation stop mode when the indoor temperature is lower than the cooling reference temperature and the indoor temperature is higher than the heating reference temperature.

16. A communication system comprising:

a communication module configured to:

communicate with a thermostat, communicate with an indoor unit configured for cooling and heating, and communicate with an outdoor unit;

an input unit configured to receive an input to execute a backup function of the thermostat; and a controller configured to:

when the backup function of the thermostat is not executed, provide an operation signal to be transmitted to the indoor unit and the outdoor unit, based on a signal received from the thermostat, when the backup function of the thermostat is executed, determine and control an operation mode of the indoor unit and the outdoor unit based on an indoor temperature, wherein when the backup function of the thermostat is executed, the controller is configured to:

provide at least one operation signal to control the indoor unit and the outdoor unit to perform a cooling operation mode when the indoor temperature is higher than a cooling reference temperature, provide at least one operation signal to control the indoor unit and the outdoor unit to perform a heating operation mode when the indoor temperature is lower than a heating reference temperature, and change the cooling reference temperature or the heating reference temperature.

* * * * *